US005276980A

United States Patent [19]

Carter et al.

[11] Patent Number: 5,276,980

[45] Date of Patent: Jan. 11, 1994

[54] REVERSIBLE CONDITIONED AIR FLOW SYSTEM

[76] Inventors: John L. Carter, 2865 NW. Bauer Woods Dr., Portland, Oreg. 97229; Michael M. Sprague, 11650 SW. Ann, Tigard, Oreg. 97223

[21] Appl. No.: 974,614

[22] Filed: Nov. 12, 1992

[51] Int. Cl.[5] ..... F26B 21/06

[52] U.S. Cl. ..... 34/191; 34/225

[58] Field of Search ..... 34/191, 196, 216, 218, 34/219, 225

[56] References Cited

U.S. PATENT DOCUMENTS 4,014,107 3/1977 Bachrich ..... 34/191

4,310,020 1/1982 Jespersen ..... 34/191 X

*Primary Examiner*—Henry A. Bennet

*Attorney, Agent, or Firm*—Kolisch, Hartwell, Dickinson, McCormack & Heuser

[57] ABSTRACT

A direct-fired kiln for drying lumber having a reversible powered air-mover mechanism for producing air circulation within the interior of the kiln in either of opposite directions. Selectively controlled air withdrawal conduits returning air to a fuel burner outside the kiln are adjusted so that air is always withdrawn from the side of a load within the kiln where circulated air is exiting from the load.

10 Claims, 2 Drawing Sheets

10
12
14
16
18
20
26
28
30
32
34
36
38
40
44
48
49
50
52
56
60
62
64
66
70
72
76
77
80
86
90
94
100
102
104
106
110
112
116
120
122
124
126
130
132
138
140
144
148
3

REVERSIBLE CONDITIONED AIR FLOW SYSTEM

BACKGROUND OF THE INVENTION

This invention relates to apparatus for processing material or product with circulated conditioned air.

Exemplary of apparatus which may incorporate the invention is a so-called direct-fired kiln or dryer. In kiln apparatus of this description, air is drawn out of the dryer and in a separate chamber conditioned as by heating it. The air is then returned and distributed within the dryer after heating. While the invention is described hereinbelow in connection with a direct-fired dryer or kiln, and embodies features specifically adapting the invention for this type of equipment, the invention is in a broader sense applicable to other types of equipment, such as apparatus utilizing heated air for the sterilizing or sanitizing of product by killing insect or organism growth, and in systems relying on the dehumidification of air withdrawn from a chamber with the air in the dehumidification being conditioned by lowering its humidity.

In conventional apparatus where air is conditioned as by heating it in a region outside the dryer or kiln chamber, air is withdrawn from the dryer chamber and thence passes through equipment such as a burner chamber where the air is heated. In a direct-fired system, the heated air together with products of combustion are then returned to the dryer chamber. In a dehumidification-type of heat system the air, after withdrawal from the kiln chamber, may be passed through a coil of a heat pump, with water condensed from the humid air stream and air after dehumidification returned to the dryer chamber. Within the dryer chamber, the air may be circulated with a power-driven reversible air-mover, such as a reversible fan system. In a drying kiln for lumber, air is caused to move with the air-mover first in one direction through the lumber load, and then after a period of time in the opposite direction through the load, with reversing of air movement tending to produce more uniform results. Typically, air has been removed from the kiln from a region which is the same irrespective of the direction of circulated air movement.

With such a construction, a number of problems arise. For instance, air at the opening in the kiln where air is withdrawn will have a different temperature depending upon which direction the air is being circulated through the load, such as a lumber load. Further explaining, if the circulation direction is such that the air at the withdrawal duct is for the most part preheated air which has not done any drying, the temperature will be considerably higher than is the case when the air is circulated in the opposite direction and such air has passed through the lumber and performed drying before reaching the withdrawal opening. Another factor is the change in air velocity through the load which occurs with reversal of the direction in the circulated air. If the withdrawal air opening is on the exit side of the load, the mover producing withdrawing of air is assisting the mover circulating air in the dryer chamber and producing air flow through the load. On the other hand, if the withdrawal opening from the kiln is in effect on the entering side of the load, the mover producing movement of air through the withdrawal opening tends to reduce the air velocity through the load. Also, with a system where air is withdrawn from one side of the load irrespective of air circulating direction, there tends to be energy waste, with exhausting of air occurring before the air has performed its drying function and moved through the load. Finally, any wet bulb sensor located on one side of the kiln interior will provide dramatically different readings depending upon the direction of air circulation.

SUMMARY OF THE INVENTION

A general object of this invention is to provide apparatus for processing product with circulated and conditioned air which makes possible a more efficient use of the conditioned air which is circulated within the chamber holding the product.

Another object is to provide apparatus which takes care of the problems above-discussed in connection with a direct-fired dryer.

More specifically, an object is to provide apparatus which includes a chamber for holding material while air is circulated therethrough, and a construction for withdrawing air for conditioning as by heating which enables the air to be extracted or withdrawn after exiting from the load irrespective of the direction in which the air is being circulated.

Another object is to provide apparatus for processing product and including a chamber for holding the product, which includes an air withdrawal duct extending along each of opposite sides of a load-holding chamber and connected to return ductwork which returns air to a heating system or other mechanism for conditioning air, and which further includes valving for selectively controlling the withdrawal ducts described.

Yet a further object is to provide a novel direct-fired dry kiln for lumber, which includes a heating system including a direct-fired burner disposed outside of and to one side of a kiln chamber, and a unique system for withdrawing air from the kiln chamber and returning this air to the burner system.

These and other objects and advantages are attained by the invention, which is described hereinbelow in conjunction with the accompanying drawings, wherein:

DETAILED DESCRIPTION OF THE PREFERRED EMBODIMENT

Figures 1, 3:
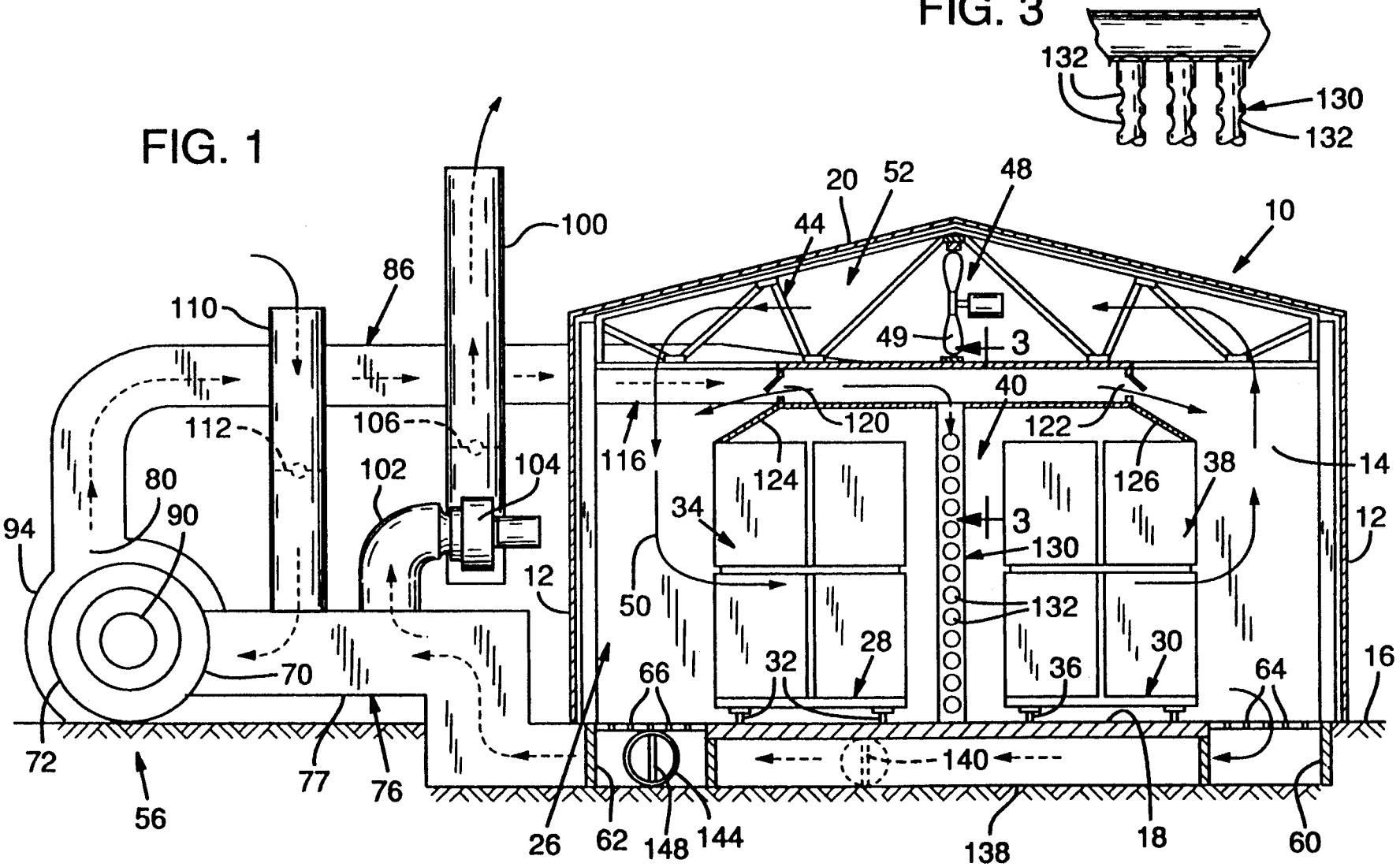
FIG. 1 is a cross-sectional elevation, in somewhat simplified form, illustrating a kiln and a direct-fired burner system for supplying hot air and gases to the kiln, and further including a circulating system for the air pursuant to the invention.
FIG. 3 is a view taken generally along the line 3—3 in FIG. 1.

Referring now to the drawings, a dry kiln such as might be used in the drying of lumber is indicated generally at 10. The kiln has upstanding side and end walls, as exemplified by sidewalls 12 and end wall 14, with these suitably resting on ground 16. Floor 18 forms the base of the kiln, and the top of the kiln is closed off by roof structure 20.

The kiln has a hollow interior providing a chamber 26 within the kiln for receiving the product to be processed which may, for example, be stacks of lumber. Supporting the stacks of lumber within the kiln are wheel-supported cars or dollies 28, 30. Car 28 is supported on tracks 32 and supports a stack of lumber 34.

Car 30 is supported on tracks 36 and supports a lumber stack 38.

Tiers or layers of lumber in the stack may be separated one from another by means such as sticks better to enable air flow between these layers and through the stack.

Tracks 32 and car 28 provide one load-holding station in the kiln, and tracks 36 and car 30 provide another load-holding station in the kiln. These stations are separated from each other by space 40. Movement of the loads on the tracks is in a direction extending toward and away from the viewer in FIG. 1.

Supporting roof structure 20 adjacent the top of the kiln is truss work 44. Supported on this truss work, between sidewalls 12, 14 of the kiln, and directly under the roof structure, is a power-driven reversible air-mover 48 mechanism. The air-mover mechanism may take the form of plural, power-driven reversible fans 49 following one another along the length of the kiln interior. The power-driven air-mover mechanism, i.e. the fans, may be operated to produce circulation of air within the kiln either in the direction illustrated by the arrows 50 in FIG. 1, or in the opposite direction. With air movement in the direction of arrows 50, the air moves in a generally counter-clockwise direction within the kiln interior, with air moving downwardly and thence across the two loads, the air then moving upwardly along the right side of the kiln and across the kiln while traveling under the roof structure from right to left in FIG. 1. With air movement in the opposite direction, air moves downwardly along the right hand sidewall and thence across the loads, the air then moving upwardly and then from left to right while traveling under the roof structure. The passage provided for air under the roof structure is referred to herein as a circulating passage, and is shown generally at 52.

Heat is supplied to the air circulated through the kiln by a direct-fired burner system 56. Such is located outside and to one side of the kiln. Suitable ductwork or ducting is provided, whereby air is withdrawn from the kiln and supplied to the burner system, and after being heated by the system, is returned to the interior of the kiln to be part of the circulated air within the kiln.

Further explaining, air is extracted from the kiln, either through withdrawal duct 60 extending along the interior of the kiln and adjacent right sidewall, or through withdrawal duct 62 extending along the interior of the kiln adjacent sidewall 12.

Duct 60, as shown, has an essentially open top closed off by a grating 64. Thus, the duct communicates along its length and adjacent floor 18 with the interior of the kiln adjacent one side of the kiln. Duct 62 is similar, having an essentially open top closed off by grating 66.

The direct-fired burner system 56 includes an intake 70 to a burner chamber 72. Connecting withdrawal ducts 60, 62 to intake 70 is return ductwork indicated generally at 76 including duct 77.

Burner chamber 72 has a discharge 80. Connecting this discharge to the interior of the kiln is supply ductwork 86.

Fuel burned within the burner chamber is burned by burner 90. A burner recirculation fan is shown at 94. With operation of the recirculation fan, air is pulled into the burner chamber through intake 70 and ductwork 76. Heated air together with combustion products are exhaustion from the burner chamber. This heated air, as super-atmospheric pressure produced by the recirculation fan, is returned to the kiln through supply ductwork 86.

Provision is made for exhausting air from the return ductwork with such exhausted air containing evaporated moisture removed from the product being dried. Specifically, an exhaust stack is shown at 100. The exhaust stack connects through duct 102 with return ductwork 76. A power-driven exhaust fan 104 when operated pulls air to be exhausted through duct 102 and this air is discharged through stack 100 into the atmosphere. Further providing for the control of exhausted air is an adjustable damper 106.

Dilution air to replace the exhausted air is supplied to the return ductwork on the upstream side of the burner chamber by dilution air stack 110. The subatmospheric pressure condition existing in return ductwork 76 adjacent the burner chamber pulls dilution air into the dilution air stack. Controlling air flow through the air stack 100 is an adjustable damper 112.

Supply ductwork 86 joins with a heat distribution duct 116. The heat distribution duct has outlet structure opening to the interior of the kiln or chamber 26 in the form of openings such as elongate opening 120 extending the length of the kiln adjacent one side of the kiln and elongate opening 122 extending the length of the kiln adjacent the opposite side, providing for the flow of heated air outwardly from the distribution duct. This supply of heated air through opening 120 is through an elongate region extending along and adjacent the top of stack 34. Air supplied through opening 122 is through an elongate region extending along and adjacent stack 38. Baffles 124, 126 which engage the tops of stack 34, 38 serve to deflect supplied air around the outside of the respective stacks.

A bank of depending conduits 130 extends along the length of the kiln in the space 40 between the load-holding stations. These conduits open to and connect with heat distribution duct 116. Provided along opposite sides of each of the conduits is a series of nozzle openings 132 constituting part of the outlet structure opening to the interior of the kiln. Heated air supplied the kiln through supply ductwork 86, in addition to passing outwardly through openings 120, 122, travels downwardly through the conduits thence to be expressed into space 40 through the nozzle openings described.

Return ductwork 76 connects with an elongate section 138 extending under the floor of the kiln. This section joins at its end with withdrawal duct 60. A damper 140 is adjustable to open and close duct section 138. With the duct section open, subatmospheric pressure in duct 77 is supplied through duct section 138 to withdrawal duct 60. With the damper closed, no subatmospheric pressure is supplied to this withdrawal duct.

Figure 2:
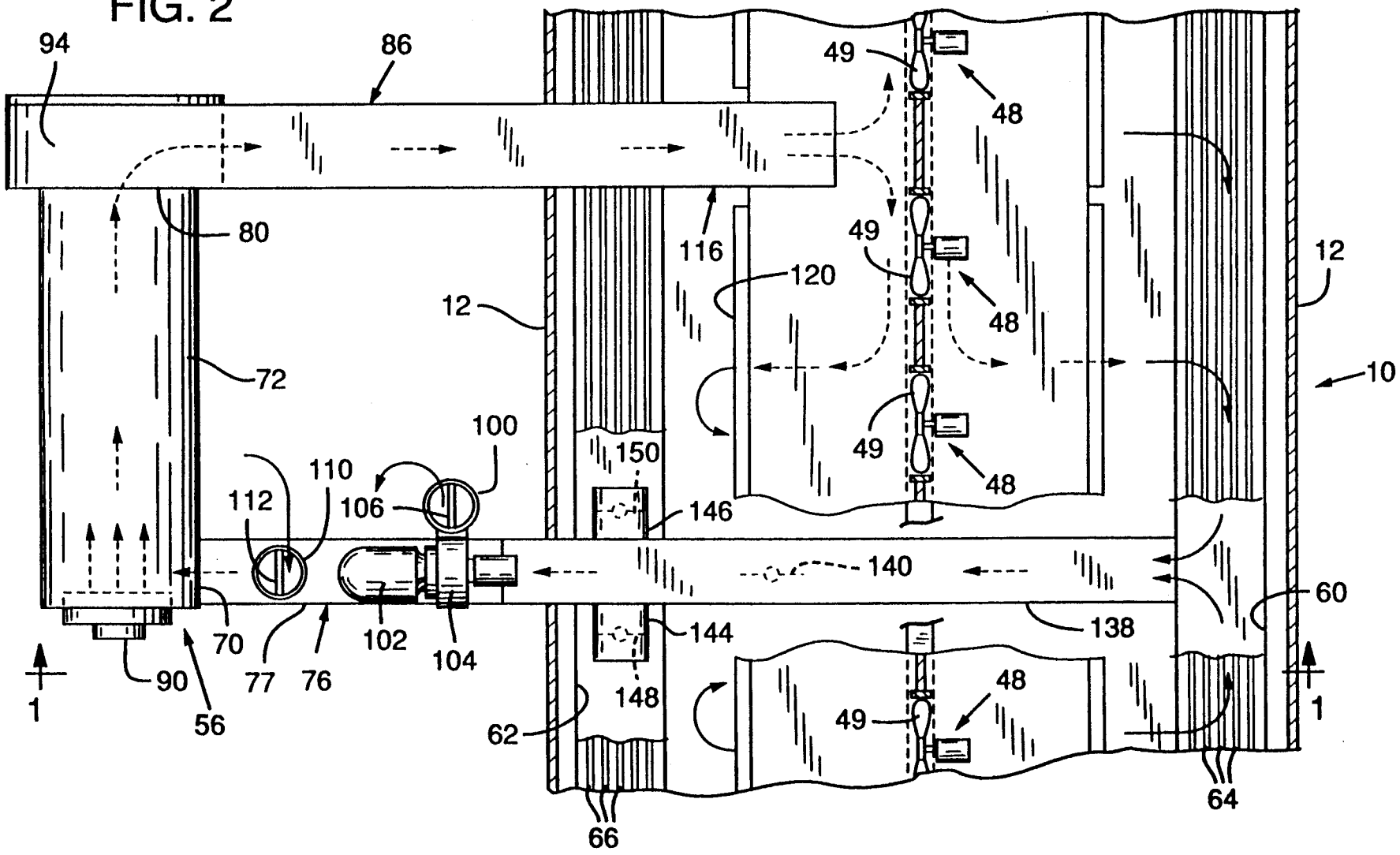
FIG. 2 is a simplified view, viewing downwardly at the kiln in FIG. 1 and with roof structure removed.

Such section 138 joins with branch sections 144, 146, and these branch sections have ends communicating with withdrawal duct 62. In these branch sections, adjustable damper valves 148, 150 are provided. With these damper valves in an open position, a subatmospheric pressure in duct 138 is supplied to withdrawal duct 60. With the damper valves in a closed position, as illustrated in FIG. 2, the branch sections are closed off and no subatmospheric pressure is supplied withdrawal duct 62.

In operating the dryer, the damper valve 140 and damper valves 148, 150 are operated selectively, and the positions of the valves depends upon the direction in which air is being circulated by the power-driven air-mover mechanism 48.

Explaining the operation of the dryer, with air-mover mechanism 48 operated to produce circulation of air within the dryer as indicated by the arrows 50, or in a counter-clockwise direction as illustrated in FIG. 1, it is contemplated that air be withdrawn or extracted from the dryer on the exit side of the load, or only after it has passed through lumber stacks 34, 38. This means that the withdrawn air should be withdrawn through withdrawal duct 60 to travel down duct section 138 and duct 177 to be admitted to the burner chamber. To produce this type of air flow, valve 140 is adjusted to a position opening duct section 138, and damper valves 148, 150 are adjusted to a position closing branch sections 144, 146. Part of the moisture-laden air being returned to the burner is exhausted through exhaust sack 100 to the atmosphere. Dilution air is supplied to the circulated air through dilution air stack 110. Air, after being heated by combustion of fuel within the burner chamber, is resupplied to the kiln through supply ductwork 86.

With the power-operated reversible air-mover mechanism operated to produce air circulation in the opposite direction, or in a clockwise direction in FIG. 1, air exits the lumber stacks on the left side of the kiln as such is illustrated in FIG. 1. With this type of air circulation, damper valve 140 is adjusted to a position closing duct section 138. Damper valves 148, 150 are adjusted to positions opening branch sections 144, 146. Air withdrawn from the interior of the kiln, therefore, is withdrawn from the left side of the kiln interior as illustrated in FIG. 1 on its travel to the intake of the burner system.

With the air return to the burner extracted at all times from the exit side of the load regardless of the circulation direction within the kiln, the returned air will have the highest relative humidity and the lowest temperature. Assurance is had, therefore, that the heating system provide optimum performance in both directions of air flow. Also, a more uniform drying of the lumber or other material results. Since air to be returned to the burner chamber is always drawn from the exiting side of the load, the air tends to be drawn at a constant velocity through the load regardless of the direction of travel of the air.

It is possible to provide any wet bulb sensor in the return air duct or in duct 77. The wet bulb sensor in this position always senses the wet bulb temperature of the air after such is passed through both lumber loads.

The control damper in the dilution or fresh air stack is controlled as required to provide proper wet bulb temperature in the air being reheated by the burner.

While a particular embodiment of the invention has been described, it is obvious that variations and modifications are possible. It is desired, therefore, to include within the invention all variations and modifications coming within the scope of the invention as herein described.

We claim:

1. Apparatus for processing a load of product with circulated conditioned air, the apparatus comprising:

housing structure and a chamber within the housing for holding the load during processing, a reversible powered air-mover mechanism for circulating air in the chamber either in one direction from one side of the chamber through the load and then around the load to return to said one chamber side or in the opposite direction from the opposite side of the chamber through the load and thence around the load to return to said opposite chamber side, one air withdrawal intake on said one side of the chamber and another air withdrawal intake on said opposite side of the chamber, conditioning mechanism for conditioning air and the conditioning mechanism having an intake and a discharge, return ductwork connecting with said one and said other withdrawal intakes and connecting said withdrawal intakes with the intake of the conditioning mechanism, and air outlet structure opening to said chamber, and supply ductwork connecting the discharge of the conditioning mechanism and said air outlet structure, the return ductwork including valving for selectively controlling air withdrawal through said withdrawal intakes by closing the withdrawal intake on said one side of the chamber and opening the withdrawal intake on the opposite side or opening the withdrawal intake on said one side of the chamber and closing of the withdrawal intake on the opposite chamber side.

2. The apparatus of claim 1, wherein a pair of load-holding stations are defined within the chamber with the load-holding stations separated by a space, and the supply ductwork includes a duct within said space and said outlet structure includes openings in said duct for the discharge of conditioned air to said space.

3. The apparatus of claim 1, wherein the reversible powered air-mover mechanism comprises a power-driven reversible fan located within said chamber.

4. The apparatus of claim 1, wherein the conditioning mechanism is a direct-fired fuel burner system which includes a burning chamber and fuel burner within the chamber for burning fuel to produce a hot air mixture which is circulated through the chamber.

5. The apparatus of claim 1, which further includes a dilution air means for the admission of dilution air and an exhaust air means for the exhausting of air, the dilution air means and the exhaust air means connecting with said return ductwork.

6. The apparatus of claim 5, wherein said dilution air means and said exhaust air means comprise a dilution air duct and an exhaust air duct, each connecting with the return ductwork and the connections with the return ductwork being intermediate the connection of the return ductwork with the withdrawal intakes and the connection of the return ductwork with the intake of the conditioning mechanism, the dilution air duct and the exhaust air duct each including valve means for controlling the flow of air therethrough.

7. A direct-fired air dryer comprising:

a kiln having an interior where drying of product is performed, a reversible power-driven air-mover mechanism for circulating air within the interior of the kiln, the kiln having a load-holding station defined within the interior of the kiln inwardly from the kiln's sides and an air circulating passage extending around the load-holding station to one side of the station, the air-mover mechanism circulating air either from one to the opposite side of the load-holding station and thence through said circulating passage or in the opposite direction from said other to the one side of the load-holding station and thence through said circulating passage, a direct-fired air burner assembly disposed outside the kiln including a burner chamber and a fuel burner within said burner chamber, an air withdrawal intake within the kiln on one side of the load-holding station and an air withdrawal intake within the kiln on the opposite side of the load-holding station, the burner chamber having an intake and a discharge, a return ductwork connecting the withdrawal intakes to the intake of the burner chamber, outlet structure opening to the interior of the kiln and a supply ductwork connecting the discharge of the burner chamber to said outlet structure, and valving for closing the withdrawal intake on one side of the load-holding station with opening of the withdrawal intake on the opposite side and for opening the withdrawal intake on said one side with closing of the withdrawal intake on the opposite side of the load-holding station.

8. The direct-fired air dryer of claim 7, wherein said reversible air-mover mechanism is disposed within said kiln at a location above said load-holding station.

9. The dryer of claim 8, wherein the kiln has a floor and said withdrawal intakes on opposite sides of the load-holding station are adjacent the floor of the kiln.

10. The dryer of claim 9, wherein a pair of load-holding stations are defined within the kiln, the stations being spaced from each other, and wherein the supply ductwork connecting with the discharge of the burner chamber includes a duct extending downwardly into said space between said load-holding stations, said outlet structure including openings in said duct.

* * * * *